US006574896B1

(12) United States Patent
Howell

(10) Patent No.: US 6,574,896 B1
(45) Date of Patent: Jun. 10, 2003

(54) GLASS PLATE PICTURE FRAME

(76) Inventor: David Howell, 333 Hook Rd., Katonah, NY (US) 10536

( * ) Notice: Subject to any disclaimer, the term of this patent is extended or adjusted under 35 U.S.C. 154(b) by 81 days.

(21) Appl. No.: 09/699,990

(22) Filed: Oct. 30, 2000

(51) Int. Cl.[7] ..... A47G 1/06
(52) U.S. Cl. ..... 40/737; 40/771
(58) Field of Search ..... 40/737, 661, 594, 40/615, 771, 772

(56) References Cited

U.S. PATENT DOCUMENTS

| | | | | | |
|---|---|---|---|---|---|
| 1,807,288 | A | * | 5/1931 | Herbert | 40/737 |
| 2,942,368 | A | * | 6/1960 | Gale | 40/737 |
| 3,237,333 | A | | 3/1966 | Bacharach | 40/152 |
| 3,341,961 | A | | 9/1967 | Shanks | 40/158 |
| 3,355,828 | A | | 12/1967 | Betz | 40/152.1 |
| 3,707,053 | A | | 12/1972 | Itano | 40/158 |
| 4,349,974 | A | | 9/1982 | Rapayelian | 40/156 |
| 4,393,612 | A | | 7/1983 | Clark | 40/152 |
| 4,741,119 | A | * | 5/1988 | Baryla | 40/594 |
| 4,869,165 | A | | 9/1989 | Louiche | 101/128.4 |
| 4,947,566 | A | | 8/1990 | Hoebel | 40/158.1 |
| 5,072,532 | A | | 12/1991 | Kelly | 50/152.1 |
| 5,222,315 | A | | 6/1993 | Lovison | 40/159 |
| 5,253,439 | A | | 10/1993 | Shanok et al. | 40/152 |
| 5,351,425 | A | | 10/1994 | Knappe et al. | 40/152.1 |
| 5,438,777 | A | | 8/1995 | Howell | 40/152.1 |
| 5,533,288 | A | | 7/1996 | Lambert | 40/754 |
| 5,623,776 | A | * | 4/1997 | Lucier | 40/209 |
| 5,713,148 | A | | 2/1998 | Lovison | 40/776 |
| 5,950,339 | A | | 9/1999 | Lucier | 40/209 |
| 5,950,342 | A | | 9/1999 | Suesholtz | 40/768 |
| 5,979,097 | A | | 11/1999 | Moore | 40/769 |

* cited by examiner

*Primary Examiner*—Cassandra H. Davis
(74) *Attorney, Agent, or Firm*—Bernhard P. Molldrem, Jr.

(57) ABSTRACT

A picture frame is constituted of a flat front glass plate and a rear frame back that is secured to the glass plate by double-sided tape. A border is screen printed onto the back surface of the glass so that it surrounds and defines a clear viewing area in which the picture is to be mounted. A design is printed on the glass in register with the border area so that the design and border are visible to a person observing the framed picture. The design can be on the front of the glass or on the back surface beneath the printed border, or designs may be printed in both places.

15 Claims, 2 Drawing Sheets

GLASS PLATE PICTURE FRAME

BACKGROUND OF THE INVENTION

This invention relates to decorative display devices, such as picture frames, and is more particularly concerned with a flat glass plate frame, in which the glass itself not only provides the clear cover through which the picture can be viewed, but also forms the frame. The invention is not limited only to glass, but can be made of any reasonably transparent rigid material, such as acrylic. The term picture as used is not limited to sketches, paintings, drawings or photographic images, but can include any material that the user wishes to display, such as calligraphy, posters or printed matter. The frame can be of any size, and can be of the easel type for standing on a dresser or mantel, or can be wall-hung.

Frame construction for pictures or art work traditionally comprise a front frame member, a glass or cover that is seated in the frame member, and a frame back. The picture is sandwiched between the glass and the frame back. A mechanism, such as glazing points or other mechanical fasteners, secure the back to the frame member. The conventional frame member can be made of four lengths of molding mitered together, or can be made of a single piece of material with cutout to accommodate the glass and frame back.

A frame construction in which the frame back is secured to the frame front with double-sided tape is described in my earlier U.S. Pat. No. 5,438,777.

A decorative picture frame that uses a flat rectangular piece of glass to serve as frame is shown in U.S. Pat. No. 5,072,532. In that arrangement, the flat glass plate is provided with a picture viewing area, and an ornamental design is etched onto a rear surface of the glass. A translucent band is also etched on the front surface of the glass around the viewing area. Then U-shaped channels are glued onto the back of the glass, and a frame backing board is slid into the channels to hold the picture against the glass.

Other display devices made without separate frame elements include holders for pictures, sports trading cards, or the like, have an integral Plexiglas or Lucite construction with front and back panels and a base, as shown, for example in U.S. Pat. No. 5,979,097.

However, none of these frame designs has created a thin, elegant and attractive appearance as has been long sought in the field of picture frames.

OBJECTS AND SUMMARY OF THE INVENTION

It is an object of this invention to provide a picture frame that represents a distinctive advance over the prior art.

It is a more specific object of this invention to provide a picture frame that is of a simple, elegant design employing only a minimum number of frame parts, that is, the glass plate, in which frame design elements are applied by silk screen or other thick film technique, a frame back, and double-sided tape or equivalent to hold the frame back onto the glass plate.

It is a more particular object to provide a picture frame that has a border element printed or deposited onto the rear surface, which can serve as a border or matte for the picture or other artwork that is displayed in the frame.

It is another object to provide a glass plate picture frame in which the design elements for the frame outside the picture area incorporate the very thickness of the glass to enhance the visual aspects of the design printed thereon.

In accordance with an aspect of the present invention, a picture frame is based on a flat front member formed of a solid transparent material, such as a rectangle of plate glass, which has a front surface and a back surface, with a clear picture area being defined in the front member, such that a picture mounted in the frame can be displayed for viewing through the picture area. A border printed onto back surface so that it surrounds the clear picture area, preferably extending to the edges of the rear surface. This can be silk screened using a suitable ink on several layers of different inks, which can be colored or metallic. This should be solid, that is, without significant voids, although it does not need to be of uniform hue or shade. A design is printed on the glass so as to be visible from the front to a viewer observing the framed picture. The design can also be screen printed either on the front of the glass in the border area, or on the rear surface in the border area. In the latter case, the design would be laid down on the glass before the solid border is printed on.

A square of double-sided adhesive tape or equivalent is affixed on the back side of the glass, disposed onto the printed border around said picture area. This can be any commercially available tape with either a solid or foam core, or any other material that will permit a suitable frame back to be adhesively secured onto it. A frame back member is adhered onto the flat front member by means of the double-sided adhesive tape. The frame back member provides means for inserting and retaining the picture at the picture area, and can also incorporate an easel stand or other mounting means.

In a preferred embodiment, a front glass plate both serves as a viewing glass for displaying a picture and also forms a surrounding decorative frame without additional frame elements. There is a solid printed border screen printed onto the back surface of the glass in a border area surrounding a picture area. The border area extends to the four edges of the glass. A design is printed onto the border area on either the front surface of the glass or on the back surface such that both the printed border and the design are visible to a viewer positioned to look at the displayed picture. At least one segment of a double-sided adhesive tape is applied onto the printed border around the picture area, the adhesive tape having adhesive on both its front and back surfaces. Then, an easel frame back is affixed onto the back surface of the front glass and is adhered to it by means of the double-sided adhesive tape. The frame back member serves as means for retaining the picture at the picture area. The frame back member is preferably co-extensive with the front glass.

The frame is not limited only to glass, and is not limited only to traditional square or rectangular shapes. The frame can, of course, be of an oval or round design, or can be octagonal, or other shape. Also, while screen printing is the preferred technique for printing the solid border and the border design, these can be accomplished with other techniques. For example, a laser printing technique can be used in some cases, or a vacuum deposition process, or a wet-process chemical deposition.

The above and many other objects, features, and advantages of this invention will become apparent from the ensuing description of selected preferred embodiments, which should be read in conjunction with the accompanying Drawing.

DETAILED DESCRIPTION OF THE PREFERRED EMBODIMENTS

FIGS. 1 to 4 illustrate one possible embodiment of a decorative glass plate picture frame of this invention and is offered as one example out of many possible variations of this invention. The picture frame need not be of any specific size or shape, but can be suited to a desired purpose, of for displaying a particular picture or other article.

Figure 1:
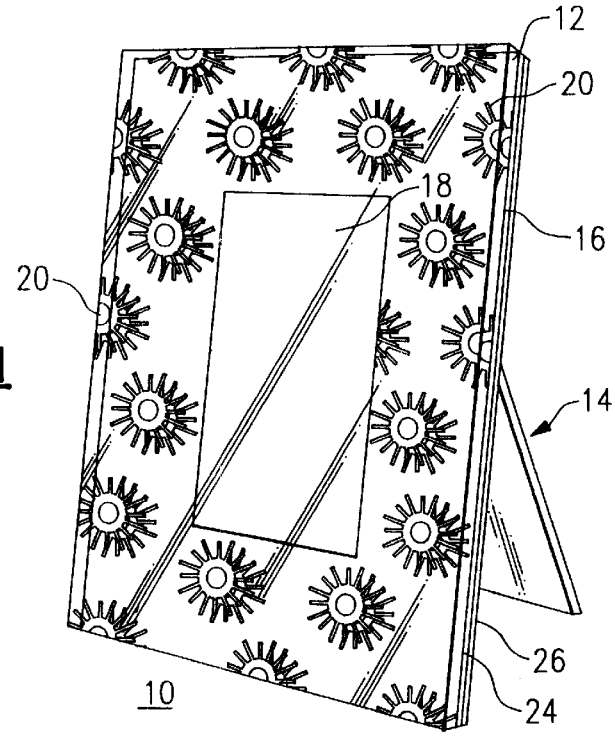
FIG. 1 is a perspective view of a glass plate picture frame according to an embodiment of this invention.
Figure 2:
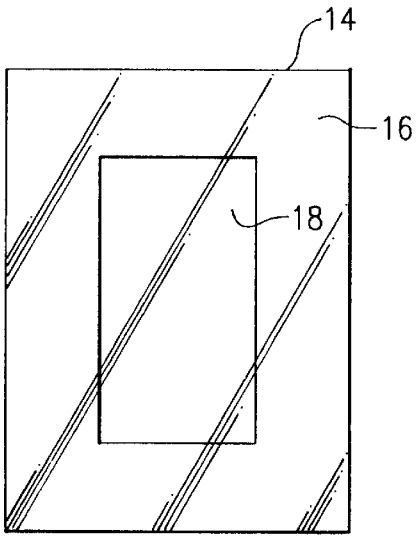
FIG. 2 is a rear view of the glass plate portion of this embodiment.

FIG. 1 illustrates a glass plate picture frame according to a first embodiment of the invention. Here, the picture frame is constituted by a rectangular glass plate 12 onto which an easel-type frame back 14 is attached. The glass plate has a screen-printed border 16 deposited on its back side. In this embodiment the border is solid, i.e., continuous and without voids or gaps, and surrounds a clear (transparent) picture viewing area 18. This is shown in the rear view of FIG. 2. A picture, that is, a photograph, drawing, or other flat artwork can be displayed in this viewing area 18, and is held in place by means of the frame back 14. In this embodiment, the viewing area 18 is more-or-less central on the glass plate 12, but in other embodiments the viewing area could be displaced towards one side, or towards a corner.

A design 20 is printed on the front surface of the glass plate 12, in general register with the border 16 and also generally coextensive with it. The rear border 16 can be a metallic ink, or can be black, white, or colored ink. It is possible that the border 16 be of uniform color, or alternatively that the hue, purity, brightness or other component of its color can be varied across the extent of the border. The front design 20 should be partially open, so that the rear border 16 is visible through at least some portions of the design 20. This results in either reflections 22 of the design 20 or shadows of the design on the rear border being visible through the front surface of the glass plate 12. The design 20 can be applied by silk screening. However, the design may be formed by other techniques, including laser etching.

Figure 3:
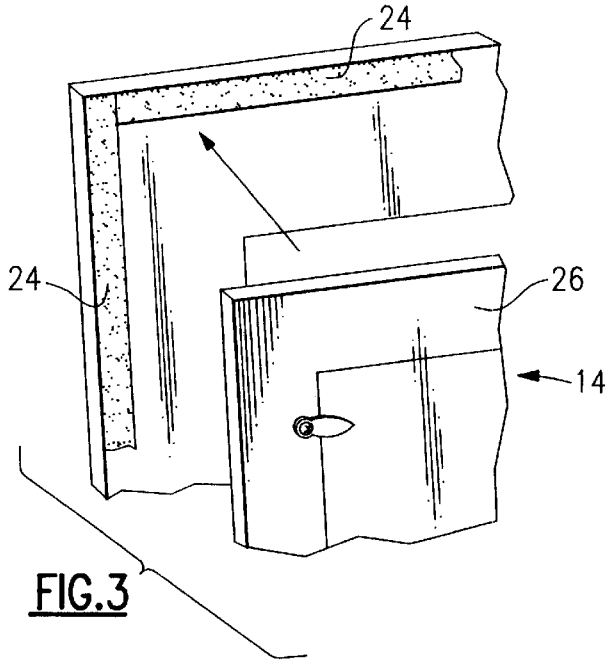
FIG. 3 is an assembly view showing portions of the front glass plate member and the frame back of this embodiment.
Figure 4:
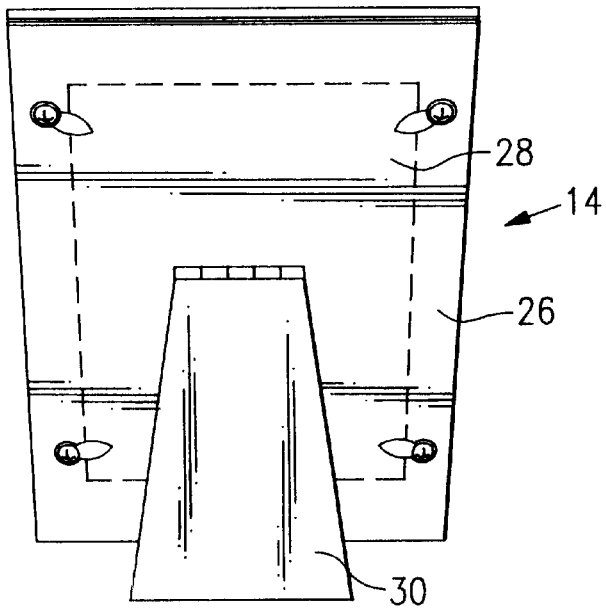
FIG. 4 is rear perspective view of this embodiment.

As shown in the assembly view of FIG. 3, lengths of double-sided adhesive tape 24 are placed on the rear surface of the glass 12 near the edges. The tape will be concealed from view through the glass by the screen-printed border 16. Then, the frame back 14 is applied, so that an outer margin 26 of the frame back is adhered to the double-sided tape. As shown in FIG. 4, the frame back 14 may have a removable central panel 28 through which the picture, i.e., photograph or other artwork, is inserted into the frame, and by means of which the picture is held in place. In this embodiment, an easel stand or foot 30 is hingedly attached to the panel 28. This permits the frame of this embodiment to stand on a table, dresser, or other horizontal surface. Of course, in other embodiments, a hanger or similar means could be provided for mounting the picture frame 10 on a wall or other vertical surface.

Figure 5:
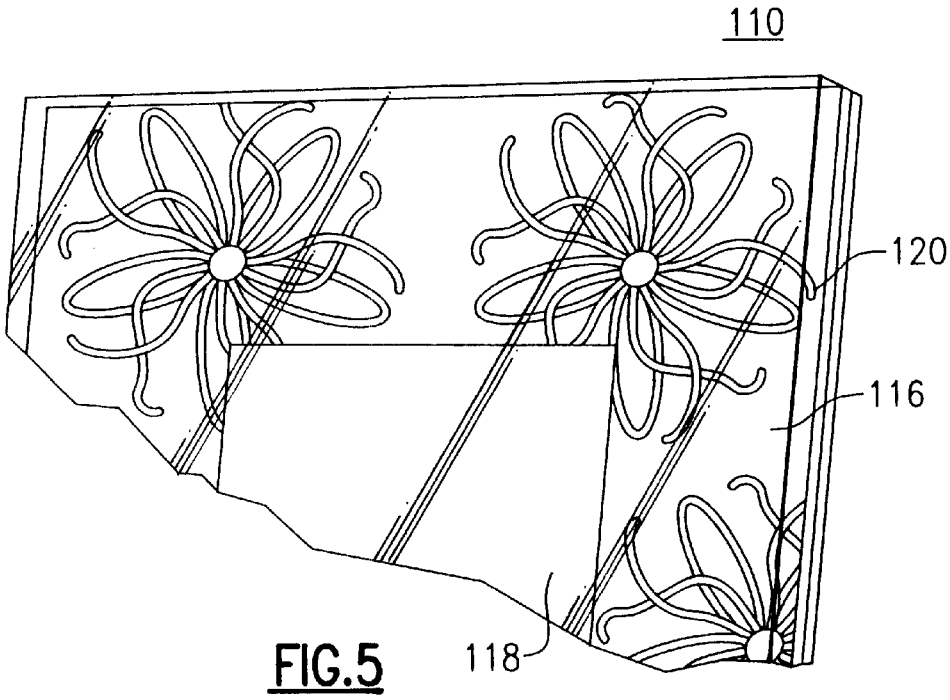
FIG. 5 is a front perspective view of a portion of another embodiment.

A second embodiment of the invention is illustrated in FIG. 5. Here, the construction of this frame 110 is similar to that of the first embodiment, except that the design is printed onto the rear surface of the glass plate with the front surface being unobstructed. The picture frame back can be the same as with the first embodiment, and may be similarly attached using double-sided tape. The parts that are identical with the first embodiment are identified with the same reference numbers, but raised by 100.

As illustrated here, the glass plate 112 of the picture frame 110 has the design 120 printed onto the margin at the rear surface, and the solid border 116 is printed on top of the printed design. These define a central picture viewing area 118. The design 120 and border 116 are both visible through the glass from the front of the picture frame.

As an alternative, the glass plate may be of round or oval shape, in which case the picture viewing window can also be of a similar round or oval shape, or in some cases may be of rectangular shape. The picture frame may also be in the form of an octagon or other shape, if desired. In other embodiments, acrylic or another clear plastic may be used for the transparent plate instead of plate glass. This construction can be useful for very large frames where overall weight may be a consideration. There are many suitable adhesive tapes that can be used for the double-sided tape 24, and many equivalents, which can adhere the frame back 14 to the front glass 12, and may provide a desired amount of spacing to accomodate the thickness of the picture, photograph, or other artwork. Also, instead of a photograph or artwork being at the viewing area 18 or 118, the glass may be silvered so that the frame 10 or 110 becomes a mirror. Also, a clock and clock face may be positioned at the viewing area 18 or 118.

While the present invention has been described in detail in respect to selected preferred embodiments, the invention is not limited to those embodiments. Rather, many modifications and variations are possible without departure from the scope and spirit of this invention, as defined in the appended Claims.

I claim:

1. A picture frame comprising:

a) a flat front member formed of a solid rigid transparent material of a finite thickness, and having a front surface and a back surface, in which a picture area is defined;

b) a border printed onto said back surface and surrounding said picture area; in which said printed border occupies entirely a space surrounding said picture area and extending to edges of the front member, and wherein said printed border is a solid color ink screen printed onto the back surface of said flat front member, and further comprising a continuous design printed onto the front surface of said flat front member in an area thereof surrounding said picture area in alignment with said printed border such that the continuous design completely surrounds said picture area, such that reflections or shadows of said design on the border on the back surface are visible through the front surface of the front flat member;

c) at least one segment of a double-sided adhesive tape disposed on said printed border around said picture area, said adhesive tape having adhesive on front and back surfaces thereof; and d) a frame back member disposed on the back surface of said front member and adhered thereto by means of said double-sided adhesive tape.

2. The picture frame according to claim 1 in which the flat front member is a transparent glass plate.

3. The picture frame according to claim 1 in which said flat front member is generally rectangular.

4. The picture frame according to claim 1 in which said printed border occupies entirely a space surrounding said picture area and extending to edges of the front member.

5. The picture frame according to claim 1 which said solid color ink is a metallic ink.

6. The picture frame according to claim 1 in which the design printed onto the front surface is comprised at least partially of a translucent ink.

7. The picture frame according to claim 1 in which at least one segment of said tape is positioned at an edge of the printed border on said flat front member.

8. The picture frame according to claim 1 in which said printed border is opaque.

9. The picture frame according to claim 1 in which the picture area is a clear area through which a picture mounted in the frame can be displayed for viewing; said frame back member including means for retaining a picture at said picture area.

10. The picture frame according to claim 1 wherein said double-sided adhesive tape is of a predetermined thickness adapted to create a desired amount of spacing between the flat front member and the frame back member to accommodate the thickness of a picture.

11. A plate glass picture frame in which a front glass both serves as a viewing glass for displaying a flat image and also forms a surrounding decorative frame without additional frame elements; comprising solid printed border screen printed onto a back surface of said front glass in a border area surrounding a picture area; a continuous design printed on a front surface of said front glass over the entire said border area such that both said printed border and said design are visible to a viewer positioned to look at said picture area, with reflections or shadows of said design on the border on the back surface being visible through the front surface of said front glass; at least one segment of a double-sided adhesive tape applied onto said printed border around said picture area, said adhesive tape having adhesive on front and back surfaces thereof; and a frame back member disposed on the back surface of the front glass and adhered thereto by means of said double-sided adhesive tape; wherein said double-sided adhesive tape is of a predetermined thickness adapted to create a desired amount of spacing between the front glass and the frame back member to accommodate the thickness of a picture.

12. The plate glass picture frame according to claim 11 in which said frame back member is substantially co-extensive with said front glass.

13. The plate glass picture frame according to claim 12 in which said frame back is an easel frame back.

14. The plate glass picture frame according to claim 11 in which said frame back member including means for retaining a picture at said picture area.

15. The plate glass picture same according to claim 11 wherein said double-sided adhesive tape is of a predetermined thickness adapted to create a desired amount of spacing between the front glass and the frame back member to accommodate the thickness of a picture.

* * * * *